US009101951B2

(12) United States Patent
Goettke

(10) Patent No.: US 9,101,951 B2
(45) Date of Patent: Aug. 11, 2015

(54) DISPENSER FOR DELIVERING LIQUID TO PASTY SUBSTANCES

(75) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 148 days.

(21) Appl. No.: 14/127,628

(22) PCT Filed: Mar. 20, 2012

(86) PCT No.: PCT/EP2012/054910
§ 371 (c)(1),
(2), (4) Date: Apr. 8, 2014

(87) PCT Pub. No.: WO2012/126909

PCT Pub. Date: Sep. 27, 2012

(65) Prior Publication Data

US 2014/0231463 A1 Aug. 21, 2014

(30) Foreign Application Priority Data

Mar. 21, 2011 (DE) ..... 20 2011 000 632 U
Mar. 24, 2011 (DE) ..... 10 2011 001 534

(51) Int. Cl.
*B65D 88/54* (2006.01)
*B05B 11/00* (2006.01)
*B65D 83/22* (2006.01)

(52) U.S. Cl.
CPC ..... *B05B 11/3042* (2013.01); *B05B 11/3001* (2013.01); *B05B 11/3053* (2013.01);
(Continued)

(58) Field of Classification Search
CPC ..... B05B 11/3021; B05B 11/3042; B05B 11/3023; B05B 11/3074; B05B 11/3047; B05B 11/3053; B05B 11/3001; B65D 83/228; B65D 83/7538; B65D 83/224; B65D 83/226; Y10T 29/4998
USPC ..... 222/321.7–321.9, 321.1, 380, 322, 222/153.06, 402.13, 402.25
See application file for complete search history.

(56) References Cited

U.S. PATENT DOCUMENTS 3,225,966 A * 12/1965 Sagarin ..... 222/153.06
3,348,740 A * 10/1967 O'Donnell ..... 222/153.06
(Continued)

FOREIGN PATENT DOCUMENTS

DE 20 2008 011 730 U1 10/2009
EP 1 958 892 A1 8/2008

OTHER PUBLICATIONS

International Search Report of PCT/EP2012/054910, mailed Jun. 14, 2012.
(Continued)

*Primary Examiner* — Lien Ngo
(74) *Attorney, Agent, or Firm* — Collard & Roe, P.C.

(57) ABSTRACT

The invention relates to a dispenser for dispensing liquid to pasty substances, with a pumping chamber and a dispensing tube (5), wherein, in order to close the dispensing tube (5), a closure part is moveable in the dispensing tube (5) between a closed position and a release position, and the dispenser has a dispenser part which is moveable in relation to a fixed dispenser part (2) during a pumping actuation. In order to design a dispensing tube which is moveable with respect to a fixed dispenser part during actuation of the dispenser in such a manner that continued advantageous actuation is possible along with advantageous production, it is proposed that the dispensing tube (5) is connected to the fixed dispenser part (2) via a predetermined breaking point (15). The invention also relates to a method for producing a dispenser by plastics injection molding, with a dispensing tube which is moveable relative to a fixed dispenser part during actuation of the dispenser. In order to provide a dispenser which is advantageous in respect of the functioning thereof and can be produced in an advantageous manner, it is proposed that the dispensing tube is injection molded integrally together with at least part of the fixed dispenser part, connected via one or more tear-off webs, and that, during the assembly or upon first actuation of the dispenser, the dispensing tube is separated from the fixed dispenser part by displacement of the dispensing tube relative to the fixed dispenser part.

10 Claims, 5 Drawing Sheets

(52) U.S. Cl.
CPC ..... *B05B11/3047* (2013.01); *B05B 11/3074* (2013.01); *B65D 83/228* (2013.01); *Y10T 29/4998* (2015.01)

(56) References Cited

U.S. PATENT DOCUMENTS 3,367,540 A * 2/1968 Lehmann ..... 222/153.06
6,318,595 B1 11/2001 Walters
7,637,399 B2 * 12/2009 Marroncles et al. ..... 222/402.13
8,028,862 B2 * 10/2011 Rossignol ..... 222/256
8,584,908 B2 * 11/2013 Kakuta ..... 222/380
2005/0006411 A1 * 1/2005 Kuwahara et al. ..... 222/321.1
2009/0272765 A1 11/2009 Seki et al.

OTHER PUBLICATIONS

International Preliminary Report on Patentability of PCT/EP2012/054910, Sep. 21, 2013.

* cited by examiner

DISPENSER FOR DELIVERING LIQUID TO PASTY SUBSTANCES

CROSS REFERENCE TO RELATED APPLICATIONS

This application is the National Stage of PCT/EP2012/054910 filed on Mar. 20, 2012 which claims priority under 35 U.S.C. §119 of German Application Nos. 20 2011 000 632.8 filed on Mar. 21, 2011 and 10 2011 001 534.5 filed on Mar. 24, 2011, the disclosures of which are incorporated by reference. The international application under PCT article 21(2) was not published in English.

The invention relates to a dispenser for dispensing liquid-to-pasty substances, having a pump chamber and a dispensing tube, wherein in order to close the dispensing tube, a closure part is movable in the dispensing tube between a closed position and a release position, and the dispenser has a dispenser part which is movable in relation to a fixed dispenser part during a pumping actuation.

A dispenser of this type is known from DE 20 2008 01 1 730 U1, for example. The content of this publication is also hereby included in the disclosure of the present application, including for the purpose of incorporating one or more of the features disclosed in the cited publication in claims of the present application.

In the known dispenser, the dispensing tube which, during a pump actuation is to be moved on a fixed dispenser part, which here is formed as an adapter part for connection to a lower part of the dispenser which preferably also contains the storage compartment, is attached by means of a spring element and is thus produced in one piece. This integration of the spring element into the dispensing tube, which itself is advantageously produced in one piece with the fixed dispenser part by plastics injection molding, is costly to manufacture. A more favorable design is sought.

In this respect, it is an object of the invention to provide a dispensing tube which is movable with respect to a fixed dispenser part during actuation of the dispenser in such a way that advantageous actuation is still possible, but still with favorable manufacture.

According to a first idea underlying the invention, a possible means for achieving this object is provided in a dispenser in which the dispensing tube is connected to the fixed dispenser part via one or more predetermined breaking points, for example when a predetermined breaking point is formed by a tear-off web. Furthermore, one-piece production of the dispensing tube and the fixed dispenser part is achieved in this way. At the same time, however, movability of the parts relative to one another can be achieved by separating the predetermined breaking points. There is no need to attach spring elements by injection molding to the fixed dispenser part on the one hand and to the dispensing tube on the other hand. The connection via predetermined breaking points may be configured so that tearing off necessarily occurs during assembly or upon first actuation. In addition, a tamper-evident closure may also be achieved in this way.

Further features of the invention are described or illustrated below, also in the description of the drawings and in the drawings, often in their preferred association with the concept already explained above, but they can also be important in an association with only one or more individual features which are described here or shown in the drawings, or independently or in an another overall concept.

Thus, it is preferred that the dispensing tube extends at an acute angle with respect to the pumping movement. Thus, the dispensing tube is not moved in the direction of its tube axis, based on a linear design of the dispensing tube, but, rather, at an angle thereto. During a pumping movement, the dispensing tube is preferably displaced parallel to itself.

Also in the embodiment described here, in first instance, for example, in principle one or more spring elements not connected to the dispensing tube or a side arm of the dispensing tube can be injection-molded onto the fixed dispenser part. After separation of the mentioned predetermined breaking points, abutment on the spring elements of the dispensing tube could then be provided. Preferably, however, the dispenser has a restoring spring associated with the pump chamber, and this restoring spring of the pump chamber also moves the dispensing tube back into its starting position after an actuation of the dispenser. In this case, the dispensing tube is spring-loaded only indirectly, not directly.

The closure part is movable during a pumping movement. If, for example, the pump head of the dispenser is depressed, the closure part frees the opening of the dispensing tube so that substance can come out. The closure part moves back into the closed position when the dispensing of substance has ended and the dispensing tube moves back into its starting position. The closure part is preferably mechanically positively controlled during a pumping movement.

It is also preferred that the positive control of the closure part relative to the dispensing tube is derived from a movement of the dispensing tube relative to the stationary dispenser part. In particular, the positive control can be achieved by interaction of a sliding block with a sliding guide.

In this connection, it is further preferred that the sliding guide has a substantially vertical extent. In this regard, a vertical extent is an extent in the direction of the pumping movement. If such a pumping movement is not vertical, the sliding guide preferably is also not vertical, but instead is provided substantially corresponding to this different direction of the pumping movement.

In a further detail, it is also preferred that the sliding guide has a vertically extending run-in section and/or runout section. Between the run-in section and runout section or above the runout section or below the run-in section, guiding in the slide, which preferably deviates from the vertical, is provided. As a result, short-term greater or lesser movement can be achieved. In particular, it is preferred that a displacement section extending at an acute angle with respect to a horizontal is provided following the run-in section or before the runout section.

The invention also relates to a method for producing a dispenser by plastics injection molding, the dispenser having a dispensing tube which is movable relative to a fixed dispenser part during actuation of the dispenser.

With regard to such a method, the object is to provide a dispenser which is advantageous with regard to its functioning or which is at least comparable to existing dispensers, and which can be produced in a favorable manner.

A possible means for achieving this object is provided in a method in which the dispensing tube is injection-molded in one piece together with at least one part of the fixed dispenser part and connected via one or more tear-off webs, and in which furthermore during the assembly or upon first actuation of the dispenser, the dispensing tube is separated from the fixed dispenser part by displacement of the dispensing tube relative to the fixed dispenser part.

The features explained above in the explanation of the configuration of the dispenser in concrete terms may clearly also be important for the method. Furthermore, features explained in the context of this method may also come into consideration for the actual design of the dispenser.

The invention is explained in greater detail below with reference to the appended drawings, which illustrate only one exemplary embodiment. In the drawings.

Figure 1:
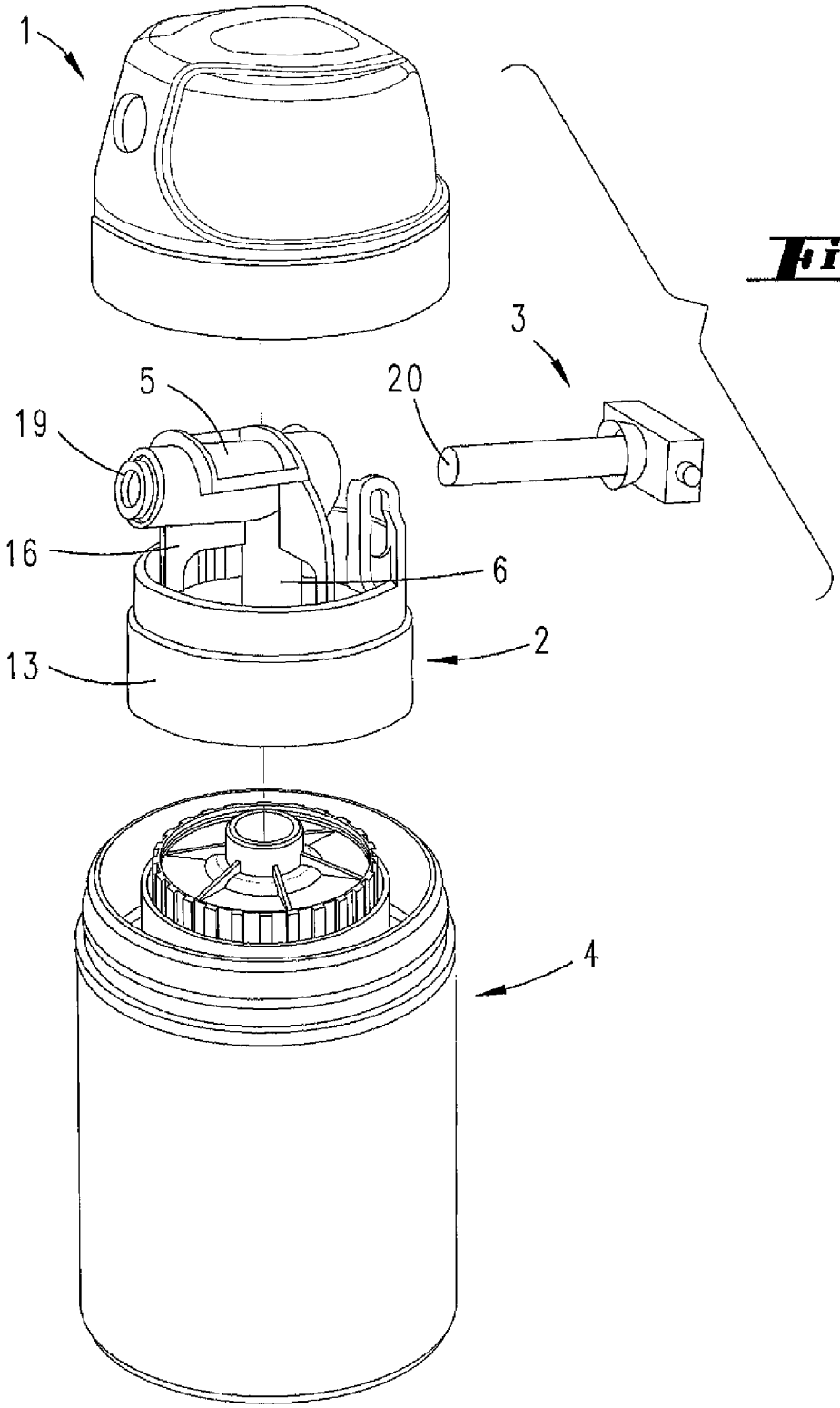
FIG. 1 shows a partially exploded view of the dispenser.

In first instance with reference to FIG. 1, a dispenser is illustrated and described, which comprises a dispenser head 1, a dispenser part 2 (illustrated here in the discharge state) having a dispensing tube 5, a closure part which is formed as a closure slide 3 and which is situated in the dispensing tube 5 in the assembled state, and a lower dispenser part 4. In the exemplary embodiment, the lower dispenser part 4 has a complete pump chamber having an inlet valve and an outlet valve, as described further below.

Figure 4:
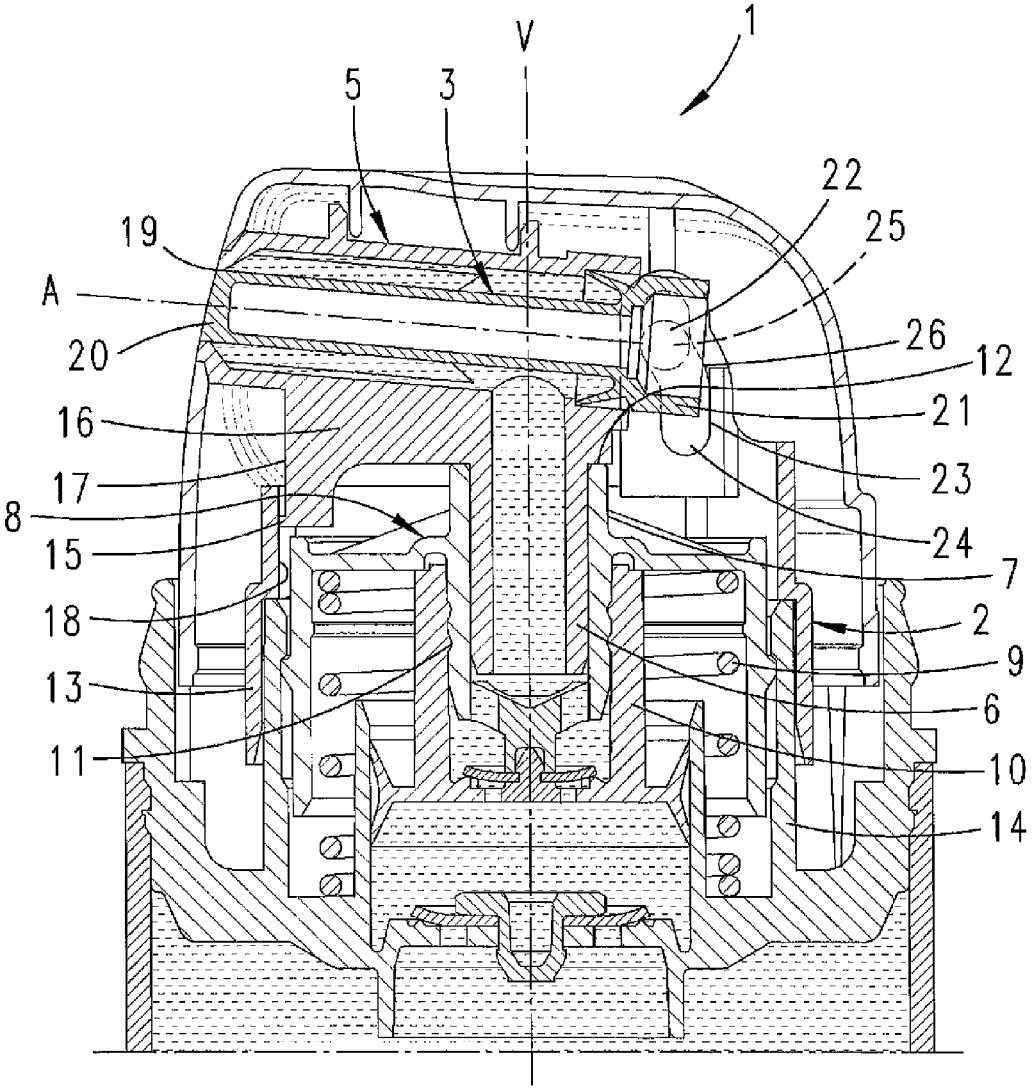
FIG. 4 shows an assembled dispenser, in cross-section, in the upper region.
Figure 5:
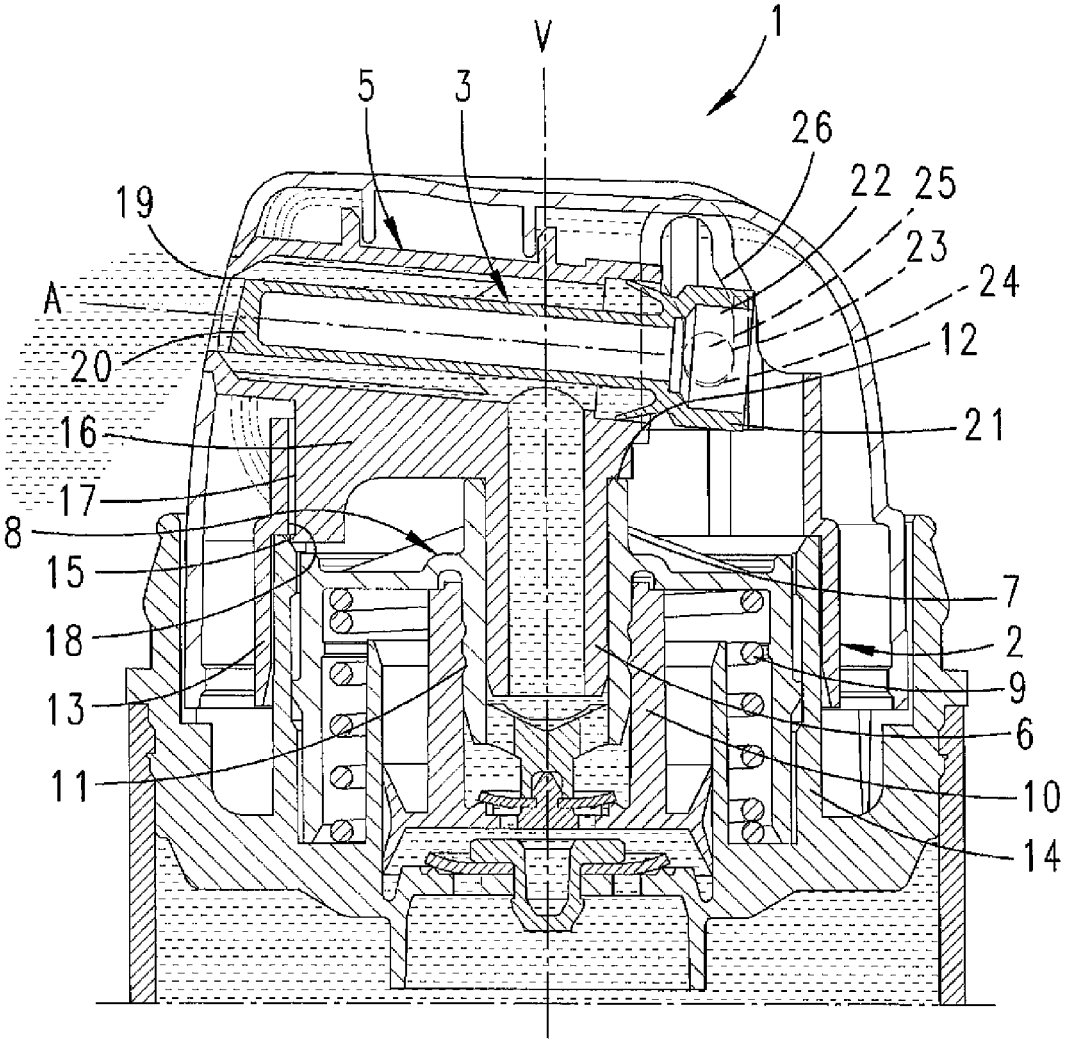
FIG. 5 shows an illustration according to FIG. 4 during actuation of the dispenser.

The dispensing tube 5 (cf. also FIGS. 2 and 3) has a longitudinal axis A which (cf. also FIGS. 4 and 5) extends at an angle $\alpha$, which in this case is an obtuse angle, with respect to a vertical axis V. During a pumping movement, the dispensing tube 5 is displaced vertically downwardly parallel to itself.

The dispensing tube 5 is preferably produced in one piece with a connecting piece 6 which extends vertically and also preferably concentrically with respect to the vertical axis V of the dispenser. In the assembled state, the dispensing tube together with the connection piece 6 protrudes into a receiving part 7. At the same time, the receiving part 7 also forms an abutment 8 for a restoring spring 9 of the pump chamber. The restoring spring 9 is preferably a steel spring.

The dispensing tube 5 cooperates with a pump piston 10, in this case by means of the connection piece 6 and, in the exemplary embodiment, also by means of the receiving part 7. In the exemplary embodiment, the pump piston 10 has a detent connection with the receiving part 7 by means of corresponding projections and recesses 11. After being depressed, the pump piston 10 is retracted into its starting position by the restoring spring 9, which acts on the receiving part 11. In this way, the dispensing tube 5, which in particular engages by means of a shoulder on the receiving part 7, is also pushed back into its dispensing position.

In the exemplary embodiment, the dispensing tube 5 is also overlaid by a cap, which forms the dispensing head 1. A user can press the dispensing head 1 in order to carry out the mentioned vertical displacement and pumping movement for dispensing the substance.

To summarize, the cap, which forms the dispenser head 1 with the dispensing tube accommodated thereon, which tube has the connecting piece 6 and a closure slide 3 inserted into the dispensing tube 5, as well as the fixed dispenser part 2, forms a module which can be pre-assembled and then fitted onto the lower dispenser part 4. The dispenser part 2, which is seated firmly in the assembled state, has a connecting skirt 13 which engages on a firmly seating guide part 14. This is a firmly seated snap-in connection.

Figure 3:
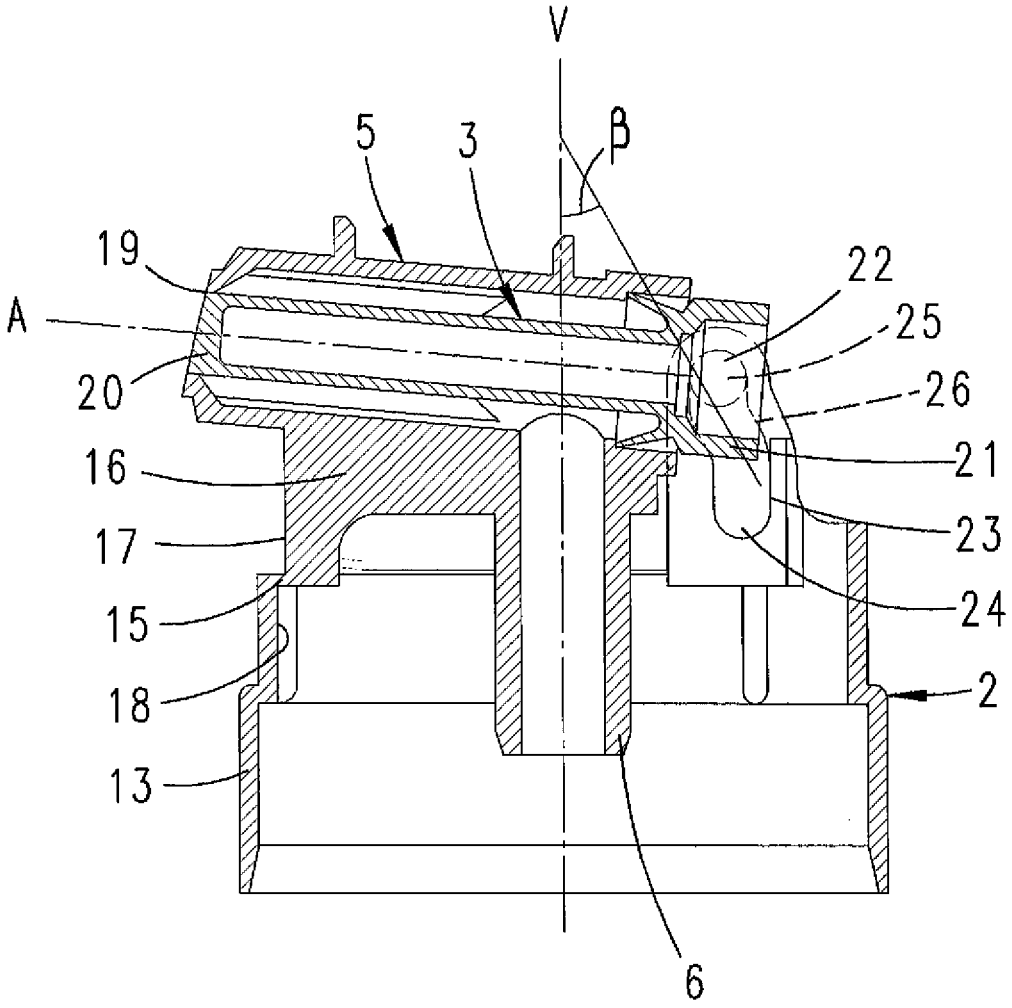
FIG. 3 shows a cross-section through the subject matter according to FIG. 2, in a sectional illustration in the plane III-III, with an inserted closure part.

In FIG. 3, the unit comprising the dispensing tube 5, connecting piece 6 and dispenser part 2 is shown in the discharge state. The dispenser part 2 is connected to the dispensing tube 5 (and accordingly is indirectly connected to the connecting piece 6 formed integrally therewith) by means of tear-off webs 15.

During assembly of the combination of the dispensing tube 5 and the dispenser part 2 formed during production, tear-off webs 15 formed in relation to this combination initially tear, resulting in free movability between the dispenser part 2 and the dispensing tube 5. The assembly may also be carried out together with the dispenser head, that is, the cap in the present case, which has already been placed onto the dispensing tube. During assembly, the connecting piece 6 is pressed into the receiving part 7 until contact is made with the shoulder 12. It can be seen here that, since the skirt part 13 engages on the guide part 14 before this, the tear-off webs 15 tear.

Figure 2:
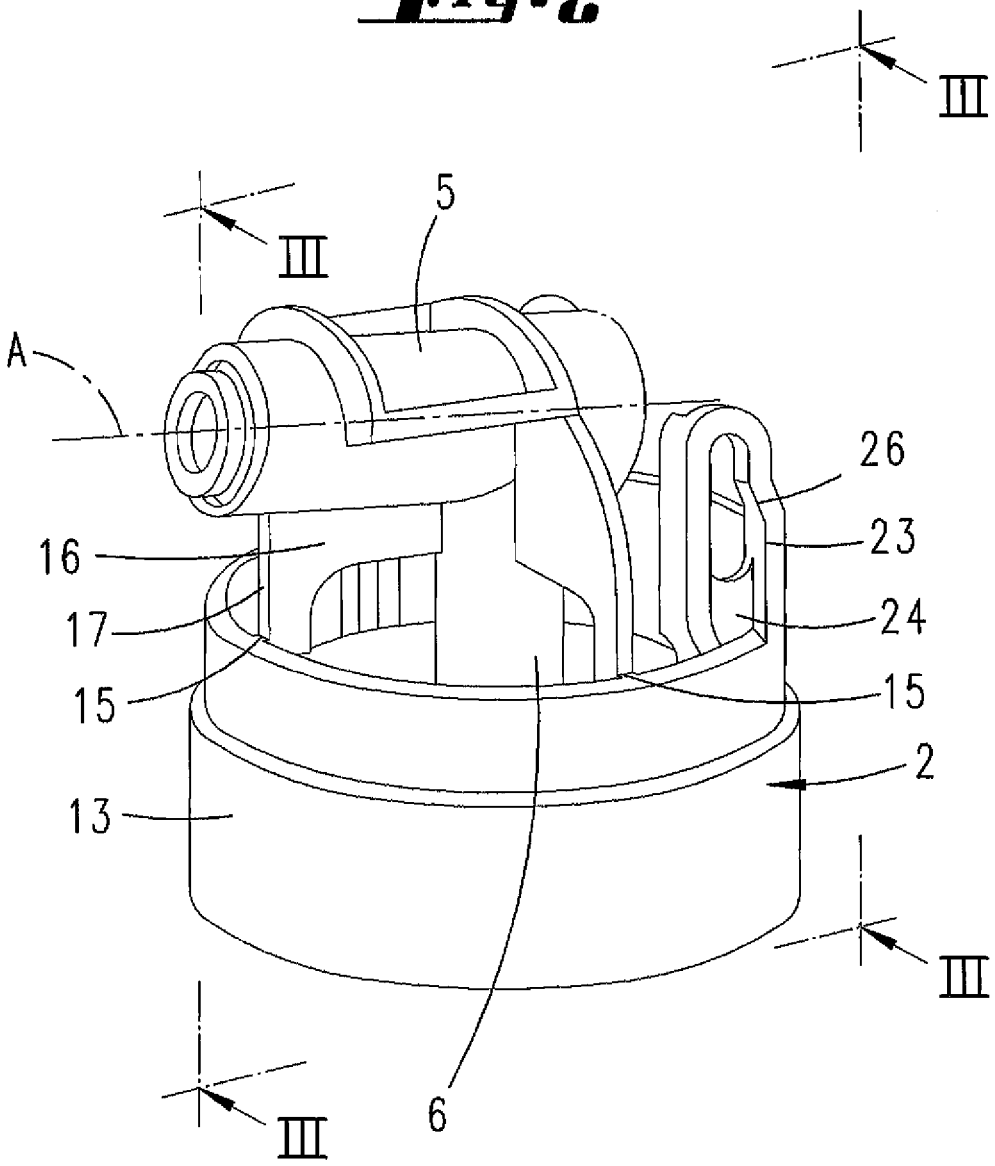
FIG. 2 shows a perspective individual illustration of the dispensing tube connected to a fixed dispenser part, in the discharge state.

One of the tear-off webs 15 is apparent in FIG. 3. More preferably, two further tear-off webs 15 are provided, of which one is indicated in FIG. 2, the other being formed opposite the tear-off web indicated in FIG. 2.

The tear-off webs between the dispensing tube 5 and the dispenser part 2 are in particular formed on web-like or plate-like connecting parts 16, which are injection-molded in one piece with the dispensing tube 5 and naturally, in the production state, also with the dispenser part 2. While the tear-off webs are attached to the dispensing tube 5 via their conventional wall thickness and extend in the radial direction with respect to the vertical axis V, they are connected to the dispenser part 2 only by means of the mentioned tear-off webs 15.

One or more of the connecting parts 16 preferably has/have a radially outer boundary edge 17 which extends at least partially vertically. During operation, when a pumping movement is carried out, but also in the rest state (see FIG. 4), this boundary edge 17 may cooperate for guiding with an inner surface 18 of the dispenser part 2 (the size of the tear-off web 15 is exaggerated in FIG. 4).

The closure slide 3 is formed as a hollow part which is closed at the front side of a delivery opening 19 of the dispensing tube 5. The closure slide has a closure base 20 associated with the mentioned delivery opening 19. At its rear end 21 protruding from the dispensing tube 5, the closure slide is provided with two oppositely situated sliding blocks 22, formed here as round pins.

The sliding blocks 22 run in a sliding guide 23, which is stationary during a pump actuation. In the exemplary embodiment, the sliding guide 23 is formed directly in one piece with the dispenser part 2. The sliding guide 23 extends substantially vertically. In any case, the sliding guide has a vertically extending lower runout section 24 and a vertically extending upper run-in section 25. A displacement section 26 is formed between the run-in section 25 and the runout section 24. As can be seen, the displacement section 26 extends at an acute angle 13 with respect to the vertical axis V. When the dispenser head is depressed by pressing on the dispenser head 1, there is still no opening produced in a first movement section, in which the sliding blocks 22 move in the run-in section of the sliding guide 23. As the pressing-down movement continues, the sliding blocks then move through the displacement section 26, so that the delivery opening 19 is completely opened over a comparatively small vertical movement section of the dispenser head 2. The closure slide 3 is moved back by the amount of offset of the displacement section 26. In the event of further possible movement vertically downwardly, the sliding blocks 22 then move in the vertical section 23, so that no further opening movement of the closure slide 3 results, but the substance is correspondingly expelled. At the end of the depression of the dispenser head 2, the dispenser head moves back into its starting position due to the restoring spring 9, the movement of the closure slide 3 as described correspondingly taking place in the reverse manner.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

List of reference numerals/characters

| | | | |
|---|---|---|---|
| 1 | dispenser head | A | longitudinal axis |
| 2 | dispenser part | V | vertical axis |
| 3 | closure slide | α | angle |
| 4 | lower part of the dispenser | β | angle |
| 5 | dispensing tube | | |
| 6 | connecting piece | | |
| 7 | receiving part | | |
| 8 | abutment | | |
| 9 | restoring spring | | |
| 10 | pump piston | | |
| 11 | receiving part | | |
| 12 | shoulder | | |
| 13 | connecting skirt | | |
| 14 | guide part | | |
| 15 | tear-off webs | | |
| 16 | connecting parts | | |
| 17 | boundary edge | | |
| 18 | inner surface | | |
| 19 | delivery opening | | |
| 20 | closure base | | |
| 21 | end | | |
| 22 | sliding blocks | | |
| 23 | sliding guide | | |
| 24 | runout section | | |
| 25 | run-in section | | |
| 26 | displacement section | | |

The invention claimed is:

1. Dispenser for dispensing liquid-to-pasty substances, having a pump chamber and a dispensing tube (5), wherein in order to close the dispensing tube (5), a closure part is movable in the dispensing tube (5) between a closed position and a release position, and the dispensing tube (5) is movable in relation to a stationary dispenser part (2) during a pumping actuation, wherein the dispensing tube (5) is connected to the stationary dispenser part (2) via a predetermined breaking point (15), wherein a tear-off web which produces the predetermined breaking point is formed between the dispensing tube (5) and the dispenser part (2) on a web-like or plate-like connecting part (16) which is injection-molded in one piece with the dispensing tube (5) and, in the production state, also with the dispenser part (2), wherein the tear-off web is attached to the dispensing tube (5) via its conventional wall thickness and extending in the radial direction with respect to the vertical axis (V), while the tear-off web is connected to the dispenser part (2) only via the mentioned tear-off web, and wherein the connecting part (16) also has a radially outer boundary edge (17) which extends at least partially vertically and which, when a pumping movement is carried out but also in the rest state, cooperates for guiding with an inner surface (18) of the dispenser part (2).

2. Dispenser according to claim 1, wherein the dispensing tube (5) extends at an obtuse angle (α) with respect to the pumping movement.

3. Dispenser according to claim 1, wherein the dispensing tube (5) is movable back into its starting position only by means of the restoring spring (9) of the pump chamber.

4. Dispenser according to claim 1, wherein the closure part is formed as a part which is movable due to a pumping movement and which is mechanically positively controlled.

5. Dispenser according to claim 4, wherein the positive control is derived from a displacement of the dispensing tube (5) relative to the stationary dispenser part (2).

6. Dispenser according to claim 4, wherein the positive control is achieved by interaction of a sliding block (22) with a sliding guide (23).

7. Dispenser according to claim 6, wherein the sliding guide (23) has a substantially vertical extent.

8. Dispenser according to claim 6, wherein the sliding guide (23) has a vertically extending run-in section and/or runout section (25, 24).

9. Dispenser according to claim 8, wherein a displacement section (26) extending at an acute angle (β) with respect to a horizontal adjoins the run-in section and/or runout section (25, 24).

10. Method for producing and assembling a dispenser by plastics injection molding, the dispenser having a dispensing tube (5) which is movable relative to a fixed dispenser part during an actuation of the dispenser, wherein the dispensing tube (5) is injection-molded in one piece together with at least one part of the fixed dispenser part, the fixed dispenser part having a connecting skirt (13) which in the assembled state engages as one piece on a guide part (14) of a lower dispenser part, connected via one or more tear-off webs, and wherein during the assembly of the dispenser, the dispensing tube is separated from the connecting skirt (13) by displacement of the dispensing tube (5) relative to the connecting skirt (13), wherein furthermore during assembly a connecting piece (6) of the dispensing tube (5) is pressed into a receiving part (7) of the lower part of the dispenser until contact is made with a shoulder (12) of the receiving part (7), and the skirt part (13) engages on the guide part (14) before this, so that the tear-off webs (15) tear during assembly.

* * * * *